United States Patent [19]

Moran

[11] 4,296,508

[45] Oct. 27, 1981

[54] BATHTUB FOR INVALIDS

[76] Inventor: Malachy J. Moran, 13915 Saratoga Rd., Saratoga, Calif. 94070

[21] Appl. No.: 135,393

[22] Filed: Mar. 31, 1980

[51] Int. Cl.[3] ..... A47K 3/022; A61H 33/02; A47K 3/12

[52] U.S. Cl. ..... 4/540; 4/546; 4/560; 4/563

[58] Field of Search ..... 4/560, 540, 546, 550, 4/554, 555, 556, 566, 561, 563, 562

[56] References Cited

U.S. PATENT DOCUMENTS

| | | | |
|---|---|---|---|
| 1,997,249 | 4/1935 | Dobbs | 4/569 |
| 2,541,263 | 2/1951 | Mayo et al. | 4/540 |
| 2,572,463 | 10/1951 | Fine | 4/549 |
| 2,977,604 | 4/1961 | Miller | 4/577 |
| 3,066,316 | 12/1962 | Russell | 4/556 |
| 3,604,018 | 9/1971 | Moran | 4/556 |
| 3,719,960 | 3/1973 | Russell | 4/556 |
| 4,118,810 | 10/1978 | Brickhouse et al. | 4/556 |

*Primary Examiner*—Henry K. Artis

*Attorney, Agent, or Firm*—David A. Boone; Allston L. Jones

[57] ABSTRACT

A special bathtub for invalids has a fixed end part which abuts an oblong rotatable end part operable by control of the pressure of the water source. The center of curvature of the abutting faces of the fixed end part and the oblong rotatable end part is offset from the pivotal axis of the rotatable end part to incorporate a wedging feature in effecting a watertight seal. An interlocking latch and water sensor prevent inadvertent opening of the tub when it is filled with water.

10 Claims, 8 Drawing Figures

BATHTUB FOR INVALIDS

BACKGROUND OF THE INVENTION

I. Field of the Invention

The present invention pertains to special bathtubs which accommodate invalids or other persons who cannot for various reasons step over the sidewall of a conventional bathtub, or easily position themselves in a bathing position. This invention particularly applies to a bathtub wherein an invalid may approach and (1) sit upon a seat in an accessible position, then be moved into the tub without raising his feet, and then be lowered into the water, or (2) walk into an open segment of the tub, and then be moved into the tub while standing and holding onto support handles.

II. Description of the Prior Art

Conventional invalid bathtubs are of three types: (1) bathtubs having rotatable end parts, as exemplified by U.S. Pat. No. 3,604,018 entitled "Bathtub" issued Sept. 14, 1971 to Malachy J. Moran; (2) bathtubs having hydraulically powered lifts for lifting a person up and into a bathtub; and (3) bathtubs having doors, as typified by U.S. Pat. No. 3,719,960. Prior art bathtubs of the first type are characterized by (a) restricted leg room during movement of the rotatable end part because of the cylindrical shape of the latter unless the diameter of the latter is increased beyond the width of the standard bathtub, (b) quickly wearing water seals and possible seal dislodgment with resultant leakage due to full compression of the seal being achieved progressively by the shearing action of the leading edge of the rotatable end part during its entire arc of travel, (c) need for a motive source of power to move the end part, and (d) possibility of spilling water if the tub is opened when full. Prior art bathtubs of the second type are especially dangerous because of the need to lift an invalid over a sidewall. Finally, prior art bathtubs of the third type are awkward to enter and difficult to seal properly.

SUMMARY OF THE INVENTION

In accordance with the illustrated preferred embodiments of the present invention, an invalid or other person may directly enter a movable end part of the bathtub through an open segment without stepping over a sidewall. The person may either sit or stand while the end part of the bathtub moves to abut and align itself with a fixed part of the bathtub. With the two parts of the bathtub abutted and aligned, the person may lower himself to any desired level by a seat which is mounted to move vertically within the movable end part of the bathtub. The person may enter or leave the bathtub without the assistance from a nurse or other attendant since the controls for the rotation of the movable end part and for vertical movement of the seat are accessible and operable, and no hazardous or difficult maneuverability is required.

In embodiments in accordance with the present invention an extended, non-cylindrical, rotatable end part may be provided to provide additional leg room to the person during entry to or exit from the bathtub. Embodiments in accordance with the present invention may include a rotatable end part with a convex cylindrical abutting surface where the axis of rotation is offset from the center of curvature of the cylindrical abutting surface for providing an improved watertight seal between the end part and the rotatable end part. Embodiments in accordance with the present invention may have a movable end part which is operable by the pressure of the water source. Also, the two end parts may be secured by an interlocking latch coupled to a water sensor. This water level sensing latch prevents spillage or leakage of water which might otherwise occur, due to inadvertent rotation of the movable end part when the bathtub contained water, by not allowing rotation of the end part when a preselected level of water is present in the bathtub.

BRIEF DESCRIPTION OF THE DRAWINGS

The drawings listed below illustrate a preferred embodiment of this invention and together with the description define the features and advantages of this invention. The views of the drawings are as follows.

DESCRIPTION OF THE PREFERRED EMBODIMENT

Figure 1:
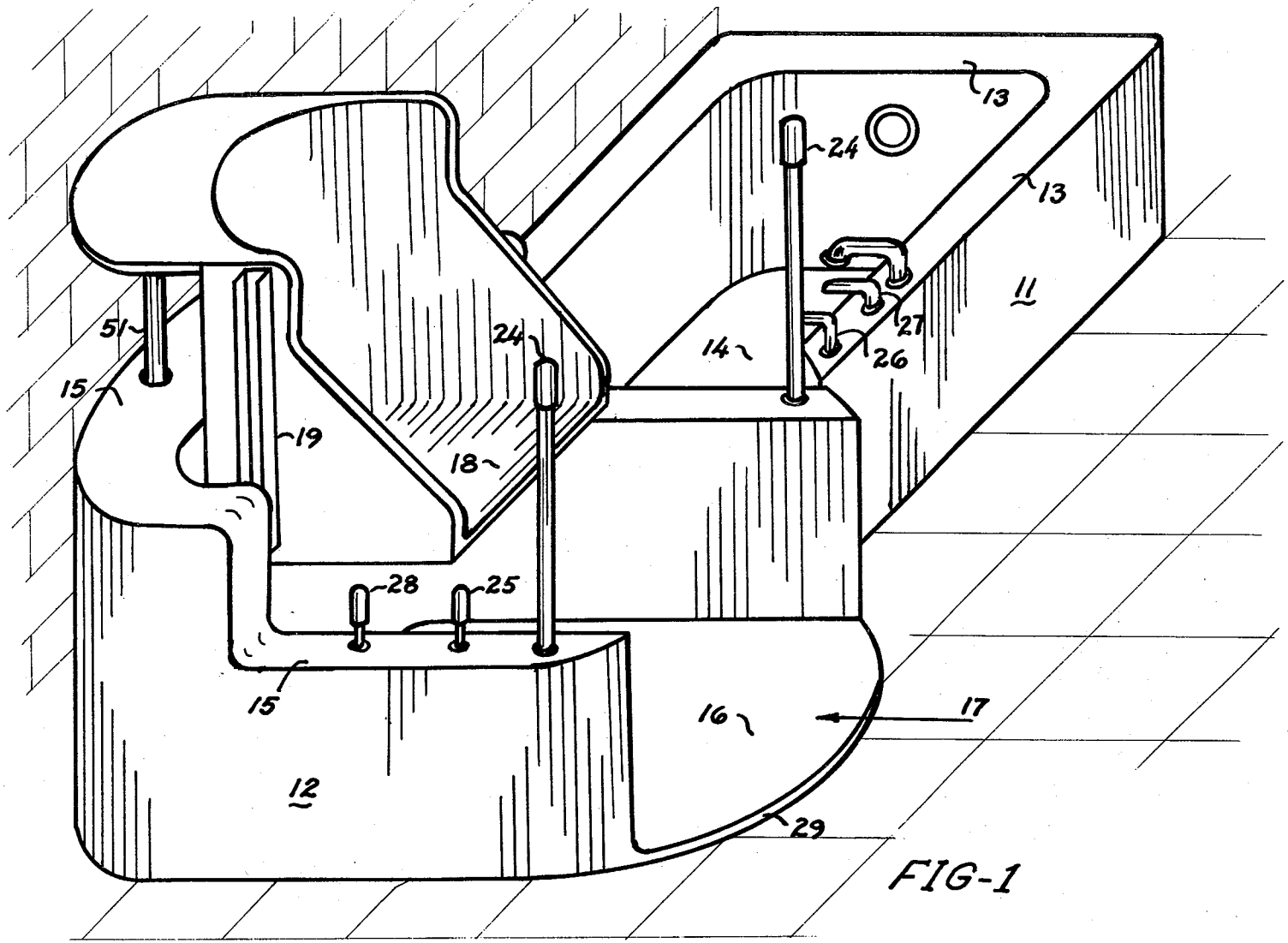
FIG. 1 is a perspective view of a bathtub in accordance with this invention, illustrating the rotatable end part in an open position for entrance or exit of a person to or from the bathtub.
Figure 2:
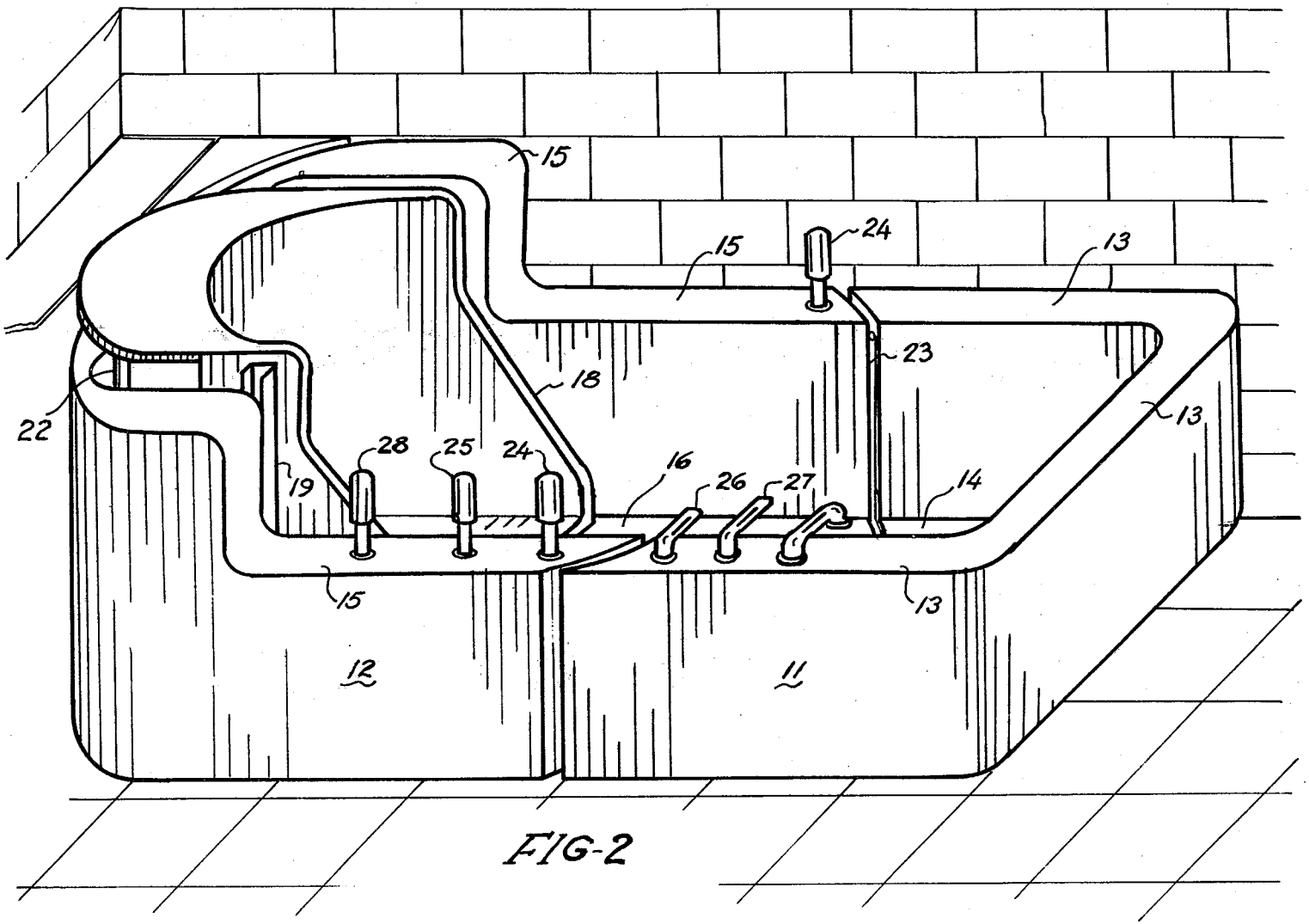
FIG. 2 is a similar perspective view, but with the rotatable end part positioned in a closed bathing position.

As illustrated in FIGS. 1 and 2, the bathtub of this invention includes a fixed part 11 and an oblong rotatable end part 12. The fixed part 11 has sidewalls 13 extending upwardly on three sides from a bottom closure 14 and has one open side. The faces of bottom closure 14 and sidewalls 13 along the open side form a portion of a concave cylindrical surface which abuts against the rotatable end part 12. Rotatable end part 12 is generally oblong in shape having cylindrical ends joined by a rectangular section, and comprises a bottom closure 16, sidewalls 15 extending upwardly from bottom closure 16 on three sides and has an open side 17 to provide an opening or passageway for entrance into and exit from the bathtub. The faces of bottom closure 16 and sidewall 15 along open side 17 form a portion of a convex cylindrical surface which abuts against the fixed part 11.

Figure 3:
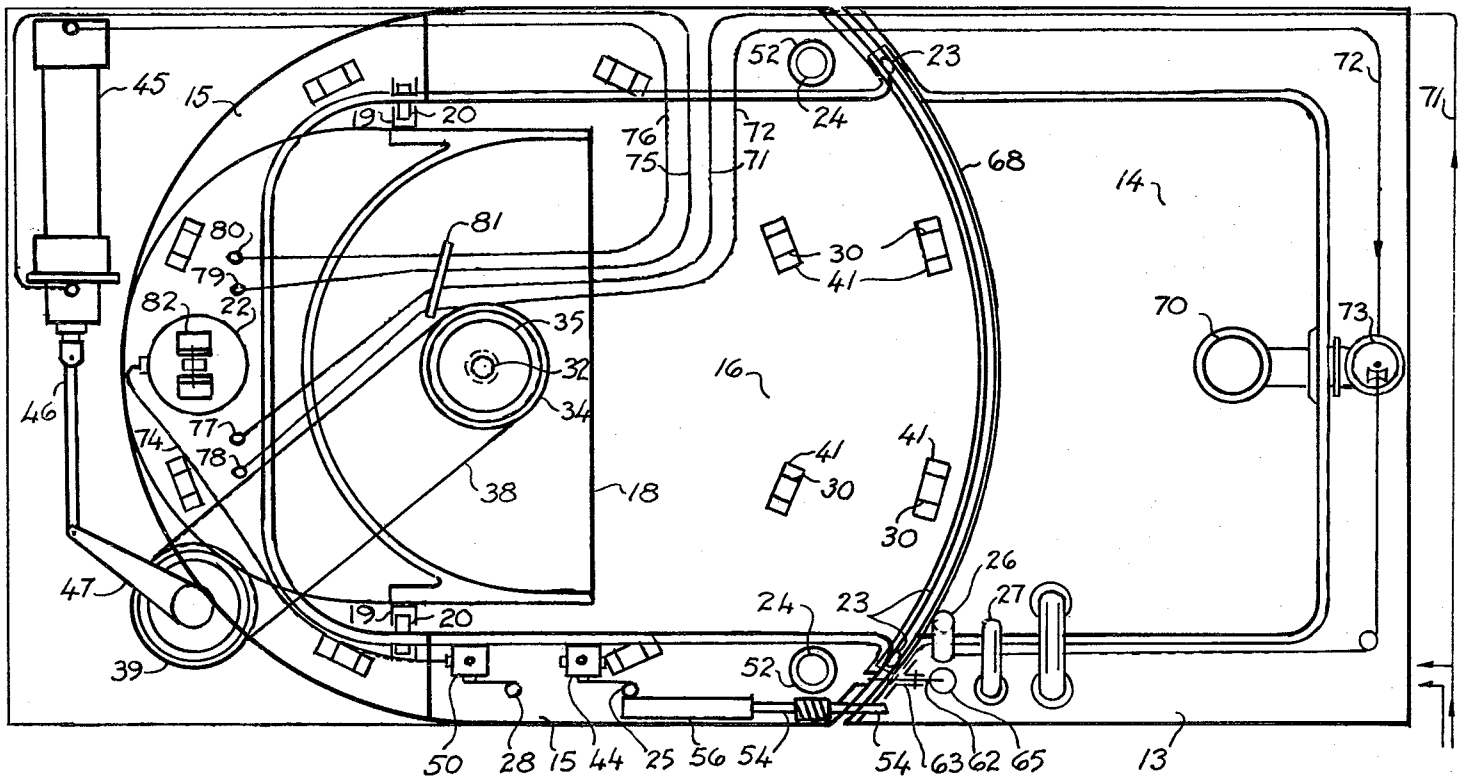
FIGS. 3 and 4 are a plan view and a profile view respectively of the bathtub, and together illustrate the drive arrangement for rotation of the movable end part and the vertical movement of the seat, control and latching arrangement of movable end part, and the locking arrangement to prevent inadvertent movement of the rotatable end part when the bathtub contains water.
Figure 4:
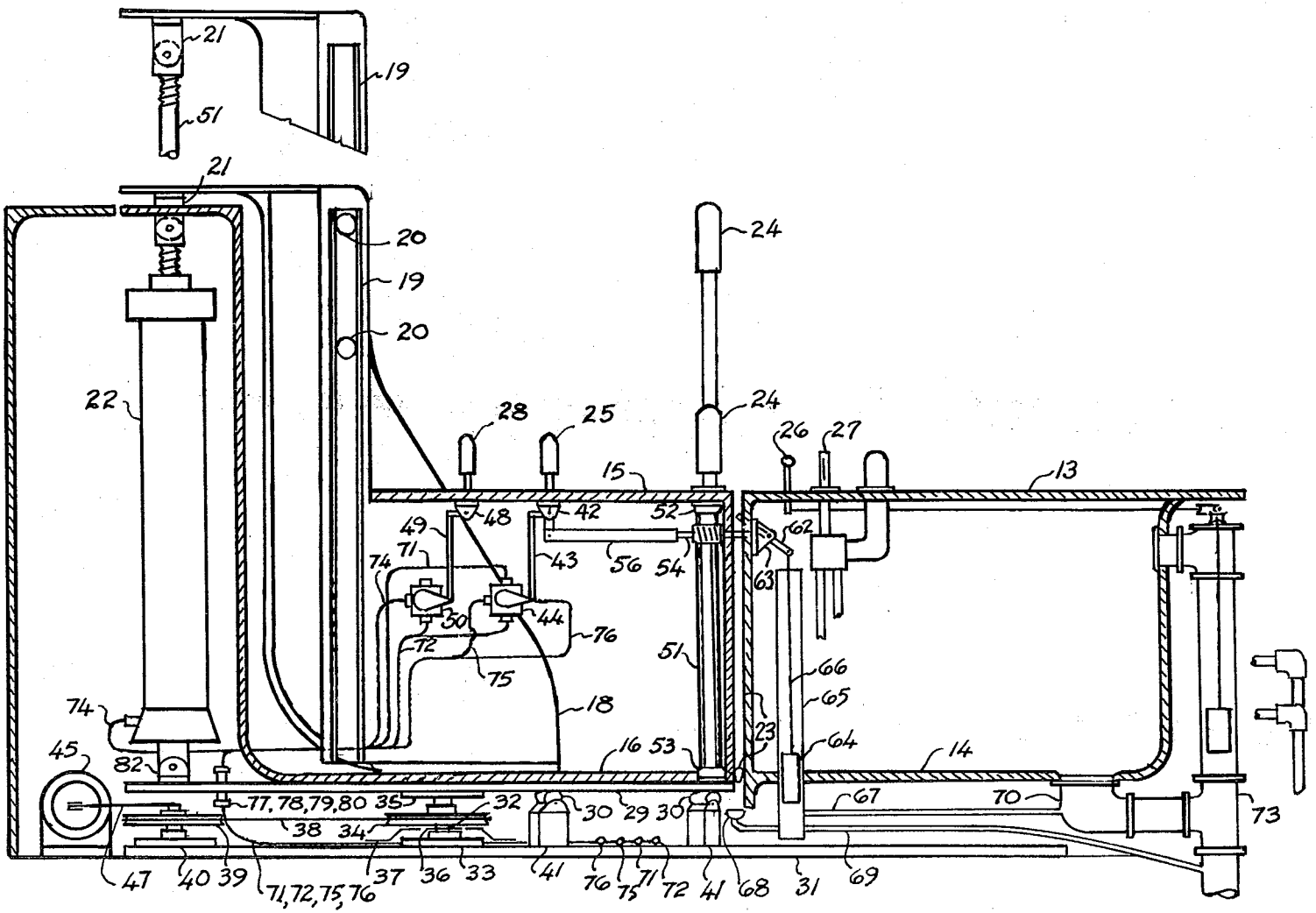

A seat 18 is mounted to move vertically inside rotatable end part 12 of the bathtub. As shown in FIGS. 3 and 4 seat 18 has affixed to it (1) a pair of channels 19 each of which is guided and controlled in its vertical movement by a pair of rollers 20 attached to sidewalls 15 and (2) a fitting 21 which transmits the force from hydraulic cylinder 22 to move seat 18 vertically. Cylinder 22 is hinged to a fitting 82 which is attached to a base plate 29. A seal 23 is affixed to end part 11 along the portions of sidewalls 13 and bottom closures 14 which abut against the end part 12.

Figure 5:
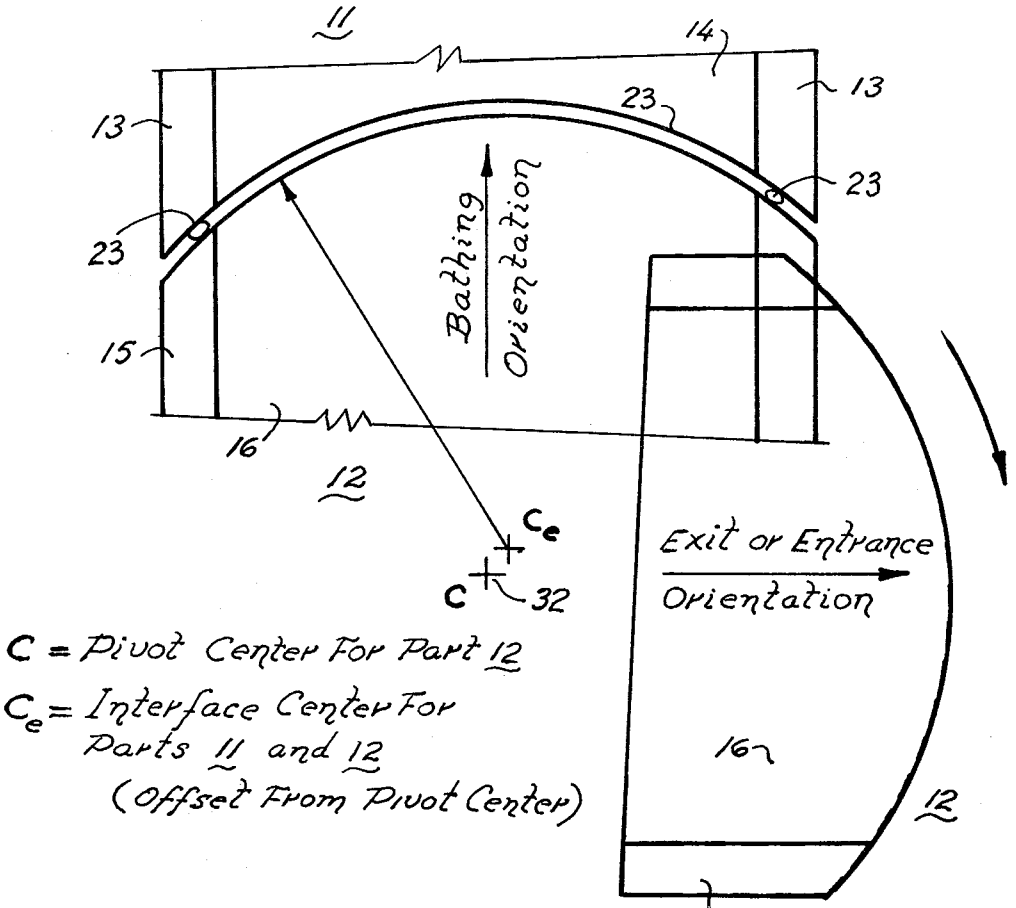
FIG. 5 illustrates a concept to effect a wedging action of the rotatable end part as it abuts against the fixed end part to result in a reliable sealing of the bathtub.

As illustrated in FIG. 5, when the bathtub is in the bathing orientation, the abutting faces of parts 11 and 12 are concentric to each other and have substantially equal radii of curvature. However, the center of curvature of the abutting face of rotatable end part 12 is offset from the pivot axis of rotatable end part 12. The resulting relative movement of the abutting faces effects a wedging action of end part 12 against fixed part 11 as end part 12 rotates about its vertical pivot axis from the open entrance orientation illustrated in FIG. 1 to the closed bathing orientation illustrated in FIG. 2. As part 12 rotates from the entrance to the bathing orientation, initially uncompressed seal 23 affixed to part 11 remains uncompressed until part 12 has rotated a number of degrees. Seal 23 is then compressed gradually to full design compression as part 12 completes its rotation. The distance from the point on the arc of travel where initial contact of part 12 with the seal occurs to full design compression of the seal at bathing orientation is determined by the magnitude and direction of the offset between the center of curvature of the abbuting faces and the pivot center of part 12. Once initial contact of part 12 with the seal is made a gradual uniform rate of seal compression over the entire length of the seal occurs until full design compression of the seal is achieved as part 12 rotates to the bathing orientation. Hence, there is less wear on the seal, less loading in the seal attachment of part 11, less probability of seal dislodgment, and a higher probability of achieving an effective seal between the abutting faces of parts 11 and 12.

As shown in FIGS. 3 and 4, a gutter 68 is attached to bottom closure 14 of end part 11. Any seepage of water past seal 23 collects in the gutter 68 and is drained by a line 69 which carries it to tub drain outlet 73.

As illustrated in FIG. 4, end part 12 is mounted on and affixed to a base plate 29 which is supported vertically by a multiple set of rollers 30 mounted on blocks 41 which are attached to a floor 31. Base plate 29 is constrained laterally by a pivot rod 32 which is mounted in a bearing 33 which is attached to the floor. Pivot rod 32 is fitted into and secured to a pulley 34 which is attached to a fitting 35 which in turn is mounted to the underside of base plate 29. To prevent tilting of part 12, pivot rod 32 is restrained from vertical movement by a protruding pin 36 embedded in rod 32 and bearing against a retainer 37 attached to floor 31. A slot in retainer 37 located outside the normal rotation of part 12 is provided to allow for the passage of pin 36 and hence to permit installation and removal of part 12. Torque to rotate the end part 12 is transmitted to pulley 34 through belt 38 from pulley 39. Pulley 39 is mounted on a spindle 40 which is attached to floor 31.

As shown in FIG. 1, a person may enter the bathtub through open side 17 of rotatable end part 12 of the bathtub, and then stand or sit with the assistance of support posts 24 when extended. As shown in FIG. 4, each post is guided and restrained by a tube 51 which is secured by fitting 52 attached to sidewall 15 at the upper end and fitting 53 to base plate 29 at the lower end.

Further, once seated, by operation of a control lever 25, the person may cause end part 12 to rotate about its pivotal axis to the closed position shown in FIG. 2 wherein the open side of rotatable part 12 faces the open side of fixed part 11. The person may then, upon operating controls 26 and 27, close the bathtub drain and draw the bathwater respectively, and then proceed to bathe himself while the seat is in the raised position, or he may operate a control lever 28 and cause seat 18 to be lowered to any desired level. As shown in FIGS. 2 and 4, the seat may be lowered to rest on bottom closure 16.

As illustrated in FIGS. 3 and 4, the control lever 25 rotates about fulcrum fitting 42, and through link 43 causes a fourway valve 44 to permit fluid pressure to actuate the hydraulic cylinder 45 which through means of link 46 and arm 47 causes pulley 39 through belt 38 to rotate pulley 34 which in turn causes end part 12 to rotate. The direction of control lever 25 movement determines whether end part 12 rotates to the entrance orientation or the bathing orientation. Each movement of control lever 25 causes fluid to flow from valve 44 into the hydraulic cylinder 45 at one end connection and existing fluid in the cylinder to flow out of the other end connection of the cylinder valve 44 and thence to the drain outlet 73. As will be discussed later in the text, movement of control lever 25 also actuates a latch mechanism to secure end part 12 to fixed part 11 when the parts are aligned in the bathing orientation.

Control lever 28 rotates about a fulcrum fitting 48 and through a link 49 causes three-way valve 50 to permit fluid pressure to actuate hydraulic cylinder 22 which through means of a fitting 21 and a hydraulic piston rod 51 causes seat 18 to move vertically upwards. By moving control lever 28 in the reverse direction three-way valve 50 shuts off the fluid inflow and allows the existing fluid in the cylinder to flow out of the cylinder and then via valve 50 to tub drain outlet 73. The force on piston rod 51 driving the fluid out of the cylinder is caused by the weight of the person on seat 18. An intermediate position of control lever 28 causes valve 50 to shut off all fluid flow to or from the cylinder and thereby allows the bather to fix the seat in any desired elevation.

Figure 6:
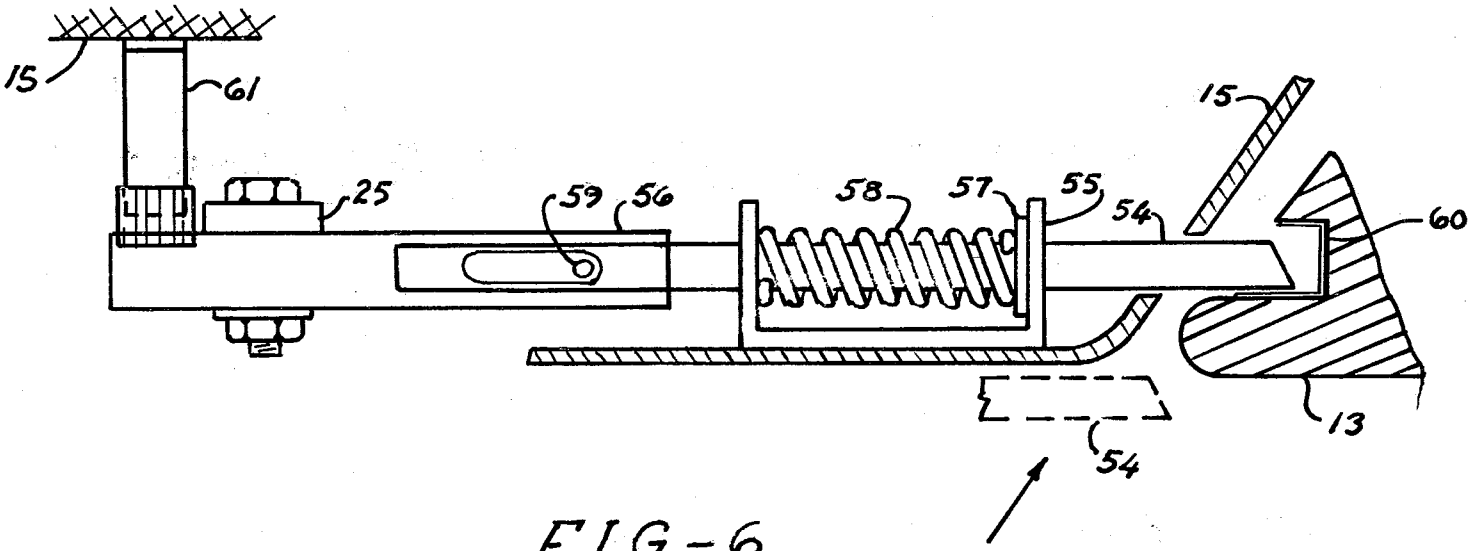
FIG. 6 shows the latching arrangement for securing the movable end part to the fixed end part.

The latch mechanism as illustrated in FIGS. 4 and 6 is mounted on sidewall 15 of rotatable end part 12 and actuated by control lever 25. The latch consists of latch 54 which is guided and supported by channel 55 and constrained in sliding motion by a tube 56 attached to control lever 25. A stop 57 on latch 54 controls a spring 58, and another stop 59 on the latch rides within a slot in tube 56.

When end part 12 is in the bathing orientation, the person may activate control lever 25 to disengage latch 54 from a receptacle 60 which is mounted and recessed in sidewall 13 of end part 11, and to rotate part 12 to the exit orientation. Disengagement is accomplished by control lever 25 retracting tube 56 which in turn, through stop 59, retracts latch 54. In so doing stop 57 compresses spring 58. When control lever 25 is activated as above it overrides a leaf spring 61 which then holds control lever 25 in position. As control lever 25 is being activated the latch is disengaged from receptacle 60 before end part 12 starts to rotate. When the person decides to rotate end part 12 from the entrance orientation to the bathing orientation he may reverse the movement of control lever 25 which action overrides leaf spring 61 and permits compressed spring 58 to extend latch 54; then, as part 12 rotates, extended latch 54 is forced backwards as it contacts and rides along the shoulder of sidewall 13. The backward movement of the latch causes stop 57 to compress spring 58, and stop 59 to slide the other end of the slot in tube 56 without tube 56 moving to affect the position of control lever 25. As end part 12 completes its rotation to the bathing orientation, latch 54 is forced into receptacle 60 by extension of the spring 58 and thus secures end part 12 to fixed part 11. The cooperation of these parts is most clearly shown in FIG. 6.

To preclude rotation of end part 12 from bathing orientation by inadvertent operation of control lever 25 while the bathtub contains water, a locking mechanism as illustrated in FIG. 4 is employed. The locking mechanism consists of a bar 62 which is hinged to two brackets 63 and operated by the vertical movement of a float 64 contained within a tube 65. When the bathtub is emptied of water, the weight of float 64 attached by a cord 66 to bar 62 causes bar 62 to pivot upwards and out of a slot in the sidewall 15 structure and thus free end part 12 to rotate from the bathing orientation. When the bathtub contains water, float 64 rises due to buoyancy of the bath water entering tube 65 through pipe 67 from the bathtub and releases the tension on cord 66 which action allows bar 62 to pivot under the action of gravity and position itself into the slot in sidewall 15.

A hydraulic power system is provided and may operate on the pressure of the household water supply. It actuates a hydraulic cylinder 22 to move seat 18 vertically and a hydraulic cylinder 45 to rotate end part 12 about its vertical pivotal axis. Control and actuation of cylinders 22 and 45 are accomplished by use of a three-way valve 50 and a four-way valve 44, respectively. As illustrated in FIGS. 3 and 4, incoming water is supplied under pressure by line 71 which is coupled to valve 44 and 50. Outgoing water from both valves is drained by line 72 to bathtub drain outlet 73.

Movement of control lever 28 in one direction causes three-way valve 50 to couple line 71 to line 74 which supplies water under pressure to cylinder 22 to cause the seat 18 to move vertically upwards. Movement of control lever 28 in a second direction causes valve 50 to couple line 72 to line 74 which drains water from cylinder 22 via line 74 as the seat moves vertically downwards under the weight of the seated bather. In a third position line 74 is decoupled from lines 71 and 72 which action secures seat 18 in a chosen position.

Movement of control lever 25 in one direction causes four-way valve 44 to supply water under pressure via line 71 to cylinder 45 via line 75 causing end part 12 to rotate about its pivotal axis while the existing water in cylinder 45 is drained via line 76 to four-way valve 44 and thence by line 72 to bathtub drain outlet 73. By reversing the movement of control lever 25 the four-way valve delivers supply water under pressure via lines 71 and 76 to cylinder 45 and drains existing water from the cylinder via lines 75 to the four-way valve and thence drained via line 72 to bathtub drain outlet 73. In a third position lines 75 and 76 are decoupled from lines 71 and 72 which action secures rotatable end part 12 in a chosen position.

The hydraulic lines as shown in FIG. 3 are stationary except for a sectional length of flexible lines 71, 72, 75 and 76 which run from their respective swivel joints 77, 78, 79, and 80 mounted on base plate 29 to a bracket 81 attached to floor 31. In the bathing orientation the flexible lines are disposed as shown in FIG. 3. As end part 12 rotates to the entrance and exit orientation, these lines are held fast at the bracket 81, rotate at their individual swivel joints 77, 78, 79, and 80 and flex to compensate for the slack which occurs due to the movement of end part 12.

Figure 7:
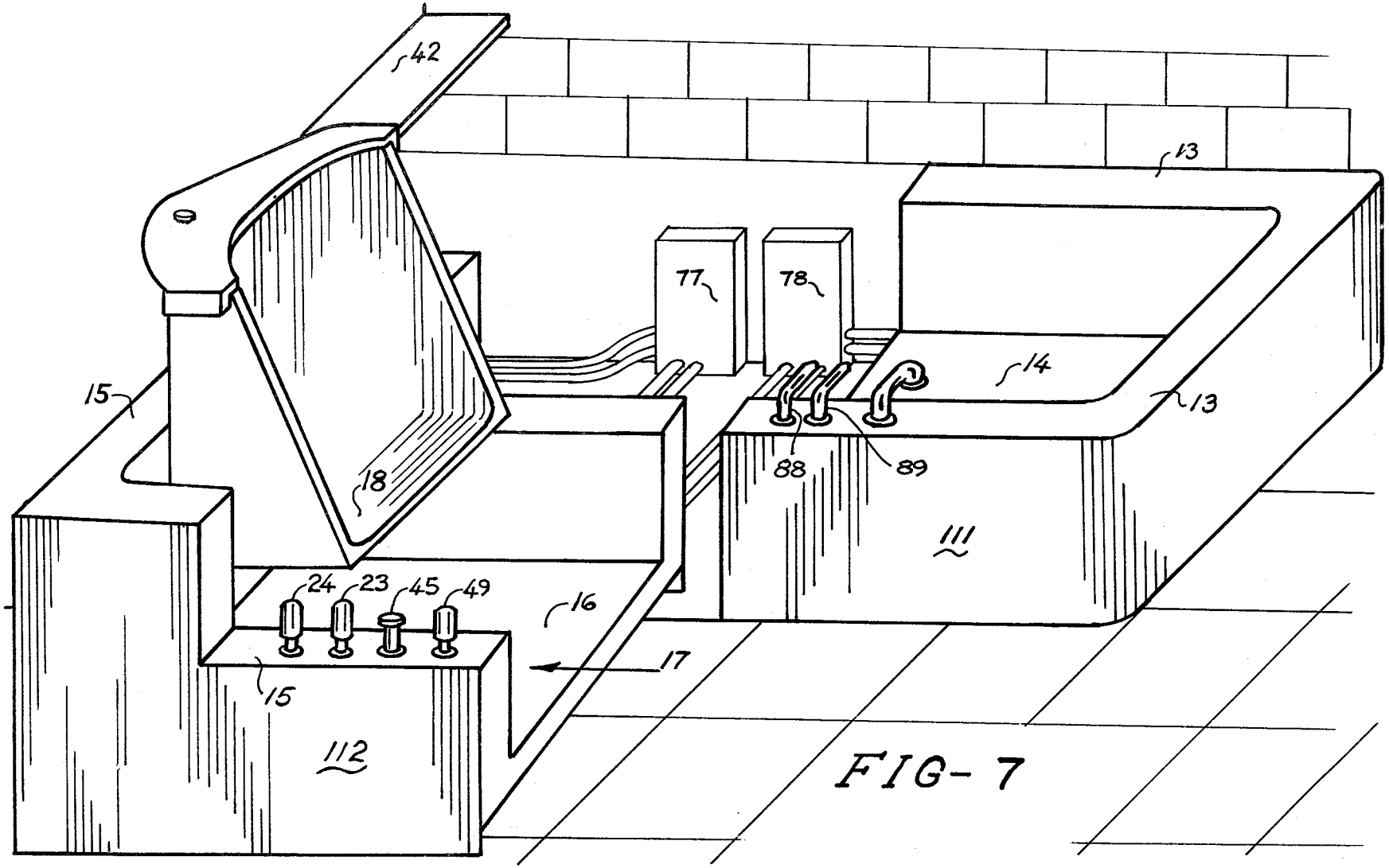
FIG. 7 is a perspective view of a bathtub in accordance with this invention, illustrating the translatable end part in an open entry/exit position.
Figure 8:
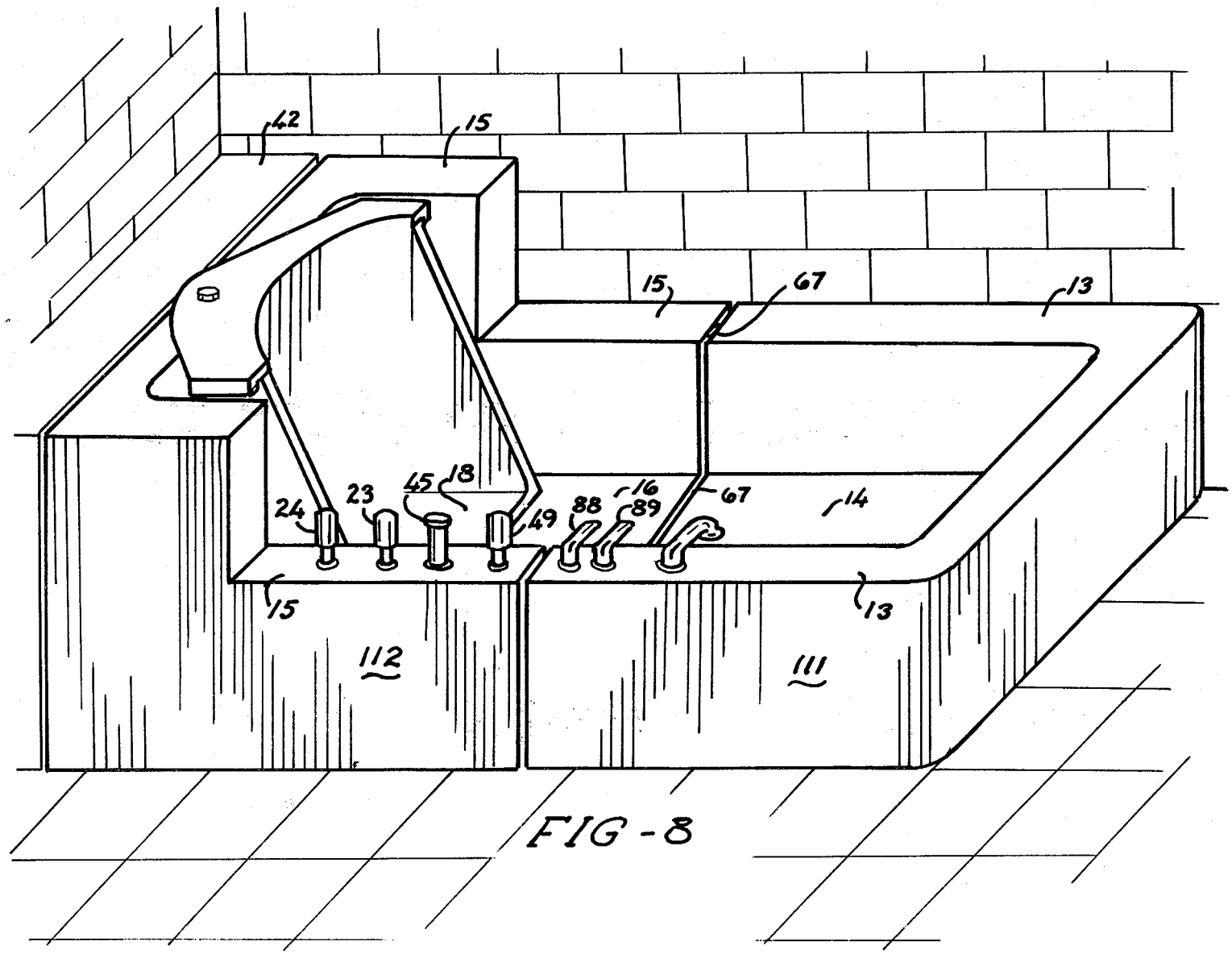
FIG. 8 is a similar perspective view of the bathtub of FIG. 7 but with the translatable end part in a closed bathtub position.

An alternative embodiment having a translatable end part is illustrated in FIGS. 7 and 8. A movable part 112 is translatably mounted relative to a fixed part 111. The mating plane of parts 111 and 112 may subtend an angle other than 90° with respect to the bathtub longitudinal axis in order to effect a degree of wedging movements as part 112 mates with part 111. The translational movement of part 112 may not be restricted to moving perpendicular to the longitudinal axis of the bathtub. The aforementioned wedging movement of part 112 reduces the rubbing action of part 112 on the seal affixed to part 111, results in positive mating with part 111 and provides for an effective sealing of the mating plane.

I claim:

1. A bathtub which can be entered without stepping over a sidewall and which provides for increased leg room during entry, the bathtub comprising:

a fixed part having a bottom closure, sidewalls extending upwardly on three sides from the bottom closure and having one open side, wherein the faces of the bottom closure and the two sidewalls along the open side form a portion of a concave cylindrical surface having a first radius about a first vertical axis;

an end part rotatable on a second vertical axis located on the bathtub centerline and having bottom closure, a back wall and two parallel sidewalls extending upwardly on three sides from the bottom closure, and having one open side, wherein the faces of the bottom closure and the two parallel sidewalls along the open side form portion of a convex cylindrical surface having a second radius about the first vertical axis; and said end part being rotatably operable from a first position wherein the open side thereof faces away from the fixed part and provides an entrance to and exit the end part and a second position wherein the cylindrical faces of the rotatable end part and fixed part abut for providing a seal therebetween.

2. A bathtub as in claim 1 wherein the first vertical axis is offset from the second vertical axis in order to produce a wedging action such that the rotatable end part applies a gradually increasing pressure on the seal affixed to the fixed end part as the rotatable end part rotates from the first to the second position and a gradually decreasing pressure as it rotates from the second to the first position, said magnitude and direction of the offset being preselected so the point on the travel arc where the rotatable end part contacts the seal and the magnitude of the final pressure it applies on the entire seal are within predetermined parameters.

3. A bathtub which can be entered without stepping over a sidewall and which prevents inadvertent spillage of water, the bathtub comprising:

a fixed part having a bottom closure, sidewalls extending upwardly on three sides from the bottom closure, and having one open side;

a rotatable end part having a bottom closure, sidewalls extending upwardly on three sides from the bottom closure, and having one open side, wherein the faces of the bottom closure and the sidewalls along the open side of the rotatable end part are adapted to abut against the seal affixed to the faces of the bottom closure and the sidewalls along the open side of the fixed part;

said rotatable end part operable to move between first position wherein the open side thereof faces away from the fixed part and provides an entrance to the rotatable end part and a second position wherein the faces of the fixed part and the rotatable end part abut and provide a seal therebetween;

water sensor means fluidically coupled to the bathtub for detecting the presence of water in the bathtub; and latch means coupled to said water sensor means for latching said rotatable end part in the second position in response to the detection of water in the bathtub by said water sensor means and for allowing movement of said rotatable end otherwise.

4. A bathtub as in claim 3 wherein said water sensor means comprises a float fluidically coupled to move upward in response to the presence of water in the bathtub and a latching bar mechanically coupled to said float, said latch biased to latch said rotatable end part in the second position in response to movement of said float upward.

5. A bathtub having a rotatable end part powered by the pressure of the water source, said bathtub comprising:

a fixed part having a bottom closure, sidewalls extending upwardly on three sides from the bottom closure, and having one open side;

a movable end part having a bottom closure, sidewalls extending upwardly on three sides from the bottom closure, and having one open side, wherein the faces of the bottom closure and the sidewalls along the open side of the movable end part are adapted to abut against the seal affixed to thefaces of the bottom closure and the sidewalls along the open side of the fixed part;

a hydraulic cylinder coupled to said movable end part for causing said movable end part to move between a first position wherein the open side thereof faces away from the fixed part and provides an entrance to the movable end part and a second position wherein the faces of the fixed part and the movable end part abut and provide a seal therebetween, said hydraulic cylinder having first and second fluidic couplings wherein the flow of fluid into the first coupling and out of the second coupling causes said movable end part to move towards the second position and the flow of fluid out of the first coupling and into the second coupling causes said movable end part to move towards the first position; and valve means fluidically coupled to said hydraulic cylinder, the water source and the drain, said valve means operable in three modes for coupling the water source to the first fluid coupling and the drain to the second fluid coupling in a first mode, for coupling the water source to the second fluid coupling and the drain to the first fluid coupling in a second mode, and for decoupling the first and second fluid couplings from the water source and drain in a third mode.

6. A bathtub as in claim 5 having a manually operable control coupled to said valve means for selecting the operating mode of said valve means and further coupled to a latch means coupled to said movable end part for latching said movable end part in the second position in response to operating said control so as to operate said valve means in the second mode and said movable end part attaining the second position, and for unlatching said movable end part from the second position in response to operating said control so as to operate said valve means in the first mode.

7. A bathtub as in claim 2 or 4 or 6, further comprising drain means adapted to catch water leaking from the abutting faces of said fixed portions and said end part, said drain means for providing a fluid path for said leakage to a bathtub drain outlet.

8. A bathtub in accordance with claim 1 and further comprising:

a seat coupled to said end part;

hydraulic means coupled to said seat and to a water input source having a hydraulic pressure for moving said seat means in response to the hydraulic pressure of said water source.

9. A bathtub as in claim 8 and further comprising control means coupled to said hydraulic means for causing said seat to be lowered and raised to, and maintained at selected positions in response to operator manifestations.

10. A bathtub as in claim 9 wherein said control means further comprises valve means coupled to said hydraulic means and said water input source for coupling water from said water input source to said hydraulic means to raise said seat, for decoupling said water source and causing said water to be contained within said hydraulic means to maintain the seat position, and for coupling the water within said hydraulic water system to a drain outlet to lower the position of said seat, in response to a manually actuable control means for controlling said valve means in response to said operator manifestations.

* * * * *